US010859953B2

(12) United States Patent
Fukamachi et al.

(10) Patent No.: US 10,859,953 B2
(45) Date of Patent: Dec. 8, 2020

(54) IMAGE FIXING DEVICE WITH A METAL SHEET THAT COVERS A HEATER AND PART OF A GUIDE PORTION THAT SLIDES AGAINST A FIXING FILM

(71) Applicant: CANON KABUSHIKI KAISHA, Tokyo (JP)

(72) Inventors: Asuna Fukamachi, Kashiwa (JP); Shohei Tsuzaki, Nagareyama (JP); Keisuke Yoshida, Tokyo (JP); Takeshi Kozuma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/667,302

(22) Filed: Oct. 29, 2019

(65) Prior Publication Data

US 2020/0133179 A1 Apr. 30, 2020

(30) Foreign Application Priority Data

Oct. 31, 2018 (JP) ..... 2018-204732

(51) Int. Cl.
*G03G 15/20* (2006.01)

(52) U.S. Cl.
CPC ..... *G03G 15/2053* (2013.01); *G03G 15/2017* (2013.01); *G03G 15/2057* (2013.01); *G03G 2215/2016* (2013.01); *G03G 2215/2035* (2013.01)

(58) Field of Classification Search
CPC ..... G03G 15/2017; G03G 15/2053; G03G 15/2057; G03G 2215/2016; G03G 2215/2035
See application file for complete search history.

(56) References Cited

U.S. PATENT DOCUMENTS

2014/0086651 A1* 3/2014 Otsu ..... G03G 15/206 399/331
2016/0274514 A1* 9/2016 Ishii ..... G03G 15/2053
2017/0097598 A1* 4/2017 Kudo ..... G03G 15/2064

FOREIGN PATENT DOCUMENTS

JP H04204980 A 7/1992
JP H05119648 A 5/1993
JP H1116667 A * 1/1999
JP H1116667 A 1/1999
JP 2016114743 A 6/2016

* cited by examiner

*Primary Examiner* — Joseph S Wong
(74) *Attorney, Agent, or Firm* — Venable LLP

(57) ABSTRACT

An image fixing device for fixing an image on a sheet includes a rotatable fixing film, a heater, a rotatable pressing member, a holding member, and a metal sheet. The heater is provided on an inner surface of the fixing belt. The rotatable pressing member is provided in contact with an outer peripheral surface of the film to press against the heater through the film, thus forming a nip configured to nip and feed the sheet. The holding member includes a guide portion configured to guide the rotation of the fixing film and to hold the heater. The metal sheet covers the heater and an area of guide portion slidable relative to an inner surface of the fixing film. The metal sheet has a thermal conductivity ≥10W/(m·° C.) and has a thickness more than 0 μm and not more than 50 μm.

9 Claims, 7 Drawing Sheets

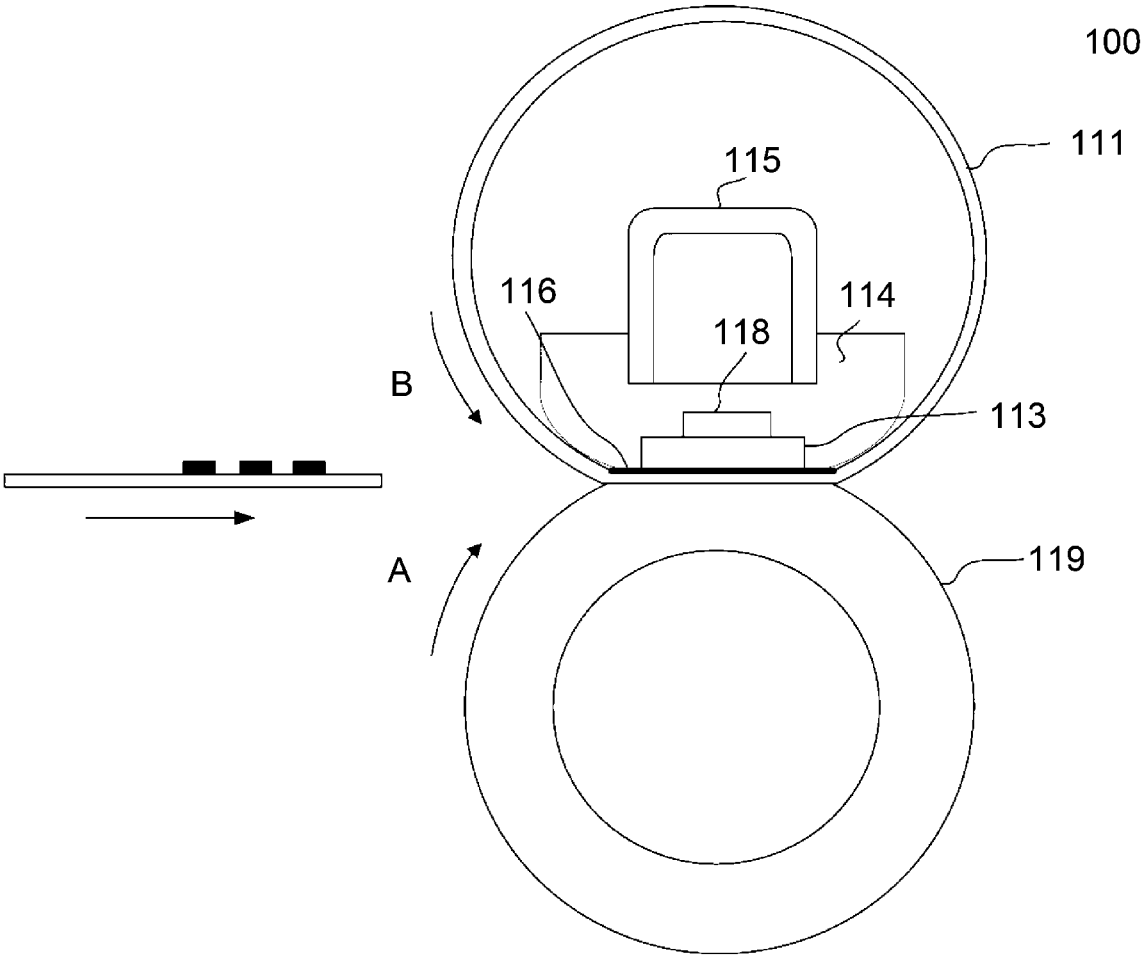
Fig. 4
(Conventional)

| | Sheet Material | Sheet Position | Anti-wear Property | Thermal Concuctivity | | Heater Temperature T | Stick-Slip Occurrence |
|---|---|---|---|---|---|---|---|
| | | | Hardness(Hv) | Themal Conductivity (W/(m°C)) | Thickness | | |
| Emb. 1 | SUS | Region S | 200 | 16.3 | 20 | 230°C | No |
| Comp. 1 | SUS | Region S | 200 | 16.3 | 100 | 270°C | No |
| Comp. 2 | Glass | Region S | 600 | 1.3 | 20 | 270°C | No |
| Comp. 3 | Al | Region S | 60 | 130 | 20 | 200°C | Yes |
| Prior Art | Sus | Region N | 200 | 16.3 | 16.3 | 230°C | Yes |

Fig. 7

IMAGE FIXING DEVICE WITH A METAL SHEET THAT COVERS A HEATER AND PART OF A GUIDE PORTION THAT SLIDES AGAINST A FIXING FILM

CROSS-REFERENCE TO RELATED APPLICATIONS

This application claims the benefit of Japanese Patent Application No. 2018-204732 filed on Oct. 31, 2018, which is hereby incorporated by reference herein in its entirety.

FIELD OF THE INVENTION AND RELATED ART

The present invention relates to an electrophotographic image forming apparatus, such as a copying machine, a printing machine, a facsimileing machine, and a multifunctional image forming apparatus, that is capable of forming an image on a sheet of recording medium. It relates also to a fixing apparatus for an electrophotographic image forming apparatus.

A fixing apparatus for an image forming apparatus such as an electrophotographic copier, printer, and so on, fixes a toner image to a sheet of recording medium after the transfer of the toner image onto the sheet. It is made up of a fixing member, as a heating member, and a pressing member positioned in such a manner that it remains pressed upon the fixing member. As the sheet, on which the toner is present, is conveyed through the nip formed by the fixing member and pressing member of the apparatus the toner image becomes fixed to the sheet.

In the field of fixing apparatus, such as the one described above, a fixing apparatus that is equipped with a fixing member in the form of a thin belt has been put into practical usage. The belt is relatively small in thermal capacity in order to reduce the length of time (warm-up time) the fixing apparatus takes for the fixing member to heat up to a preset temperature level necessary for the fixing member to fix a toner image, that is, the time from when the fixing apparatus is turned on to the time when it becomes ready for fixation.

Japanese Laid-open Patent Application No. H04-204980 discloses a fixing apparatus that is equipped with a belt (which hereafter may be referred to as fixation belt), as a fixing member. This fixing apparatus comprises a fixation belt, a flat ceramic heater, and a pressure roller, as a pressing member. The fixing apparatus is structured so that the ceramic heater is disposed on the inward side of the loop which the belt forms, and a nip is formed between the heater and pressure roller, with the placement of the fixation belt between the ceramic heater and pressure roller. Further, the fixing apparatus is structured so that rotation of the pressure roller rotates the fixation belt. As a sheet of recording medium is conveyed through the nip, unfixed toner of an unfixed toner image on the sheet is heated while being pressed. Consequently, the unfixed toner image becomes fixed to the sheet.

Further, Japanese Laid-open Patent Application No. H11-16667 discloses a fixing apparatus that comprises a heater holding member, and a thermally conductive plate, which is roughly in the form of a semicircular trough, in addition to the components comprising the aforementioned fixing apparatus. This fixing apparatus is structured so that the heater is covered with the thermally conductive plate in order to prevent the problem that the inward surface of the fixation belt is damaged by being intensively rubbed by the heater and/or heater holding member.

However, a fixing apparatus, such as the one structured as disclosed in Japanese Laid-open Patent Application No. H11-16667, suffers from the following problem. That is, the friction between the fixation belt and heater holding member was not reduced, making it likely for the fixation belt to stick and slip as it slides on the heater holding member. Therefore, the belt movement of this fixing apparatus is unsatisfactory.

Thus, the present invention was made to improve a fixing apparatus having a heater and a heater holding member, not only in the manner in which the fixation belt slides on the combination of the heater and heater holding member, but also, the manner in which the fixation belt slides on the heater holding member alone, in order to prevent the fixation belt from sticking and slipping as it slides on the combination of the heater and heater holding member.

SUMMARY OF THE INVENTION

Thus, the primary object of the present invention is to provide a fixing apparatus, which is structured to form a nip between its heater and fixation belt, and yet, is significantly superior to any similarly structured conventional fixing apparatus in terms of the manner in which the fixation belt slides on the combination of the heater and heater holding member.

According to one aspect the present invention provides an image fixing device for fixing an image on a recording material. The fixing device includes a rotatable fixing film, a heater, a holding member, and a metal sheet. The heater is provided on an inner surface of the fixing belt. The rotatable pressing member is provided in contact with an outer peripheral surface of the fixing film to press against the heater through the fixing film, thus forming a nip configured to nip and feed the recording material. The holding member includes a guide portion configured to guide the rotation of the fixing film and to hold the heater. The metal sheet covers the heater and an area of guide portion slidable relative to an inner surface of the fixing film. The metal sheet has a thermal conductivity ≥10 W/(m·° C.) and has a thickness more than 0 μm and not more than 50 μm.

Further features of the present invention will become apparent from the following description of exemplary embodiments (with reference to the attached drawings).

BRIEF DESCRIPTION OF THE DRAWINGS

FIG. 4 is a cross-sectional view of a conventional fixing apparatus.

FIG. 7 is a table which shows the results of the comparison among the fixing apparatus in the first embodiment, comparative ones, and a conventional one, in terms of various properties of theirs.

DESCRIPTION OF THE EMBODIMENTS

Hereafter, preferred embodiments of the present invention are described with reference to appended drawings.

Embodiment 1

Figure 2:
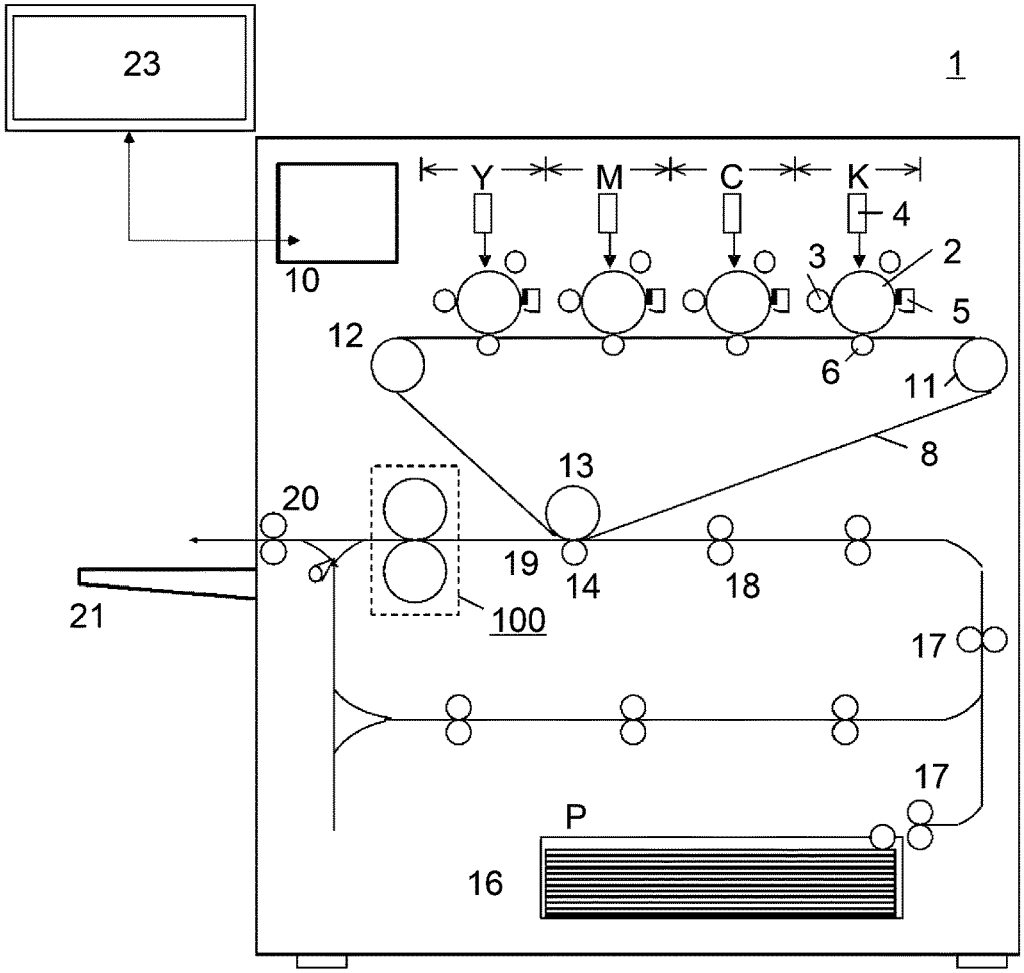
FIG. 2 is a sectional view of the image forming apparatus in the first embodiment; it shows the general structure of the apparatus.

First, referring to FIG. 2, the general structure of the image forming apparatus in this embodiment is described. Then, the fixing apparatus of the image forming apparatus is described in detail. The image forming apparatus in this embodiment is a laser beam printer which uses an electrophotographic image forming method. Hereafter, this electrophotographic color printer is referred to simply as a "printer".

1. Image Forming Apparatus (Printer)

The printer shown in FIG. 2 is equipped with four image forming portions U, which form Y (yellow), M (magenta), C (cyan) and Bk (black) images, one for one. A photosensitive drum 2 is charged in advance by a charge roller 3. Then, a latent image is formed on the photosensitive drum 2 by a laser scanner 4. The latent image is developed into a toner image by a developing device 5. Then, the four toner images on the four photosensitive drums 2, one for one, are sequentially transferred onto an intermediary transfer belt, for example, which also is an image bearing member. Meanwhile, sheets S of recording medium stored in the first or second sheet feeder cassette 16 are fed one by one into the main assembly of the image forming apparatus, while being separated from the rest in the cassette 15, by the operation of a sheet feeding mechanism. Then, each sheet S of recording medium is sent to a pair of registration rollers 18 through a sheet conveyance passage 19. The pair of registration rollers 18 catch the sheet S and temporarily hold the sheet S, correcting the sheet S in attitude in a case when the sheet S happens to be delivered askew. Then, the pair of registration rollers 18 deliver the sheet S to the interface (nip) between the intermediary transfer belt 8 and a secondary transfer roller 14 in synchronism with the arrival of the color toner image on the intermediary transfer belt 8 at the interface. Then, while the sheet S is conveyed through the interface, the color toner image on the intermediary transfer belt 8 is transferred onto the sheet S by a secondary transfer roller 14, which also is a transferring member. Then, the toner image on the sheet S is fixed to the surface of the sheet S by being heated, while being pressed, by the fixing apparatus 100. Thereafter, the sheet S, to which the toner image has just been fixed, is discharged by a pair of discharge rollers 20, into a delivery tray 21, which is a part of the top portion of the image forming apparatus.

Figure 3:
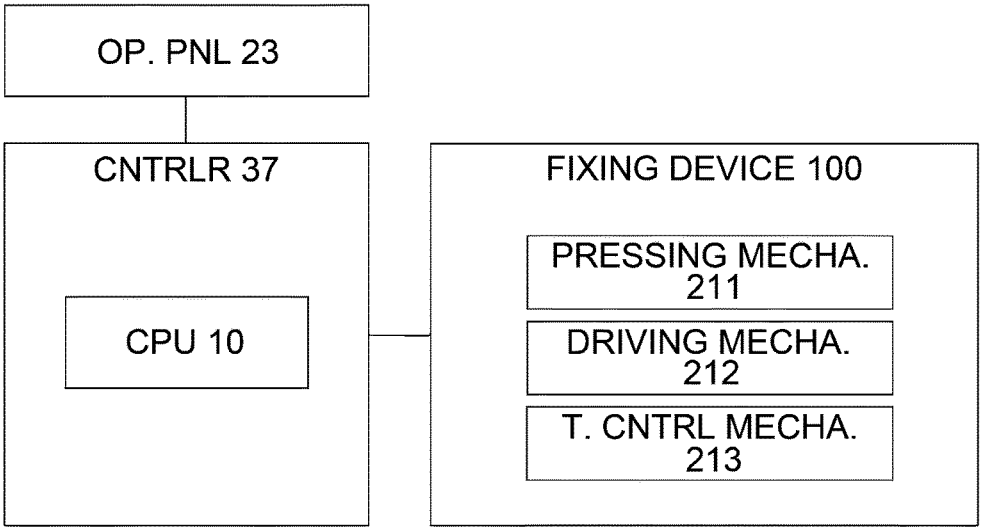
FIG. 3 is a block diagram of the control system of the image forming apparatus (fixing apparatus) in the first embodiment.

Next, referring to FIG. 3, the printer is provided with a controller 37, which is for controlling the fixing apparatus and the portions related thereto, and a control panel 23 which functions as an interface for allowing a user to access the apparatus. Typically, the controller 37 comprises a CPU 10, which controls the command unit (system) among various operational units of the printer while monitoring the operation of each unit. The control panel 23 enables a user to set up the image forming apparatus based on information regarding a printing job (such as basis weight and surface properties of recording medium, density level at which image to be formed, print count, printing mode regarding two-side or single-side, etc.) By the way, the information regarding a printing job can be directly inputted into the image forming apparatus from an external PC or the like, instead of through the control panel 23. The controller 37 activates the pressing mechanism 211, driving mechanism 212, etc., of the fixing apparatus 100 in response to a command from the CPU 10, to operate a temperature controlling system 213.

2. Fixing Apparatus

Figure 1:
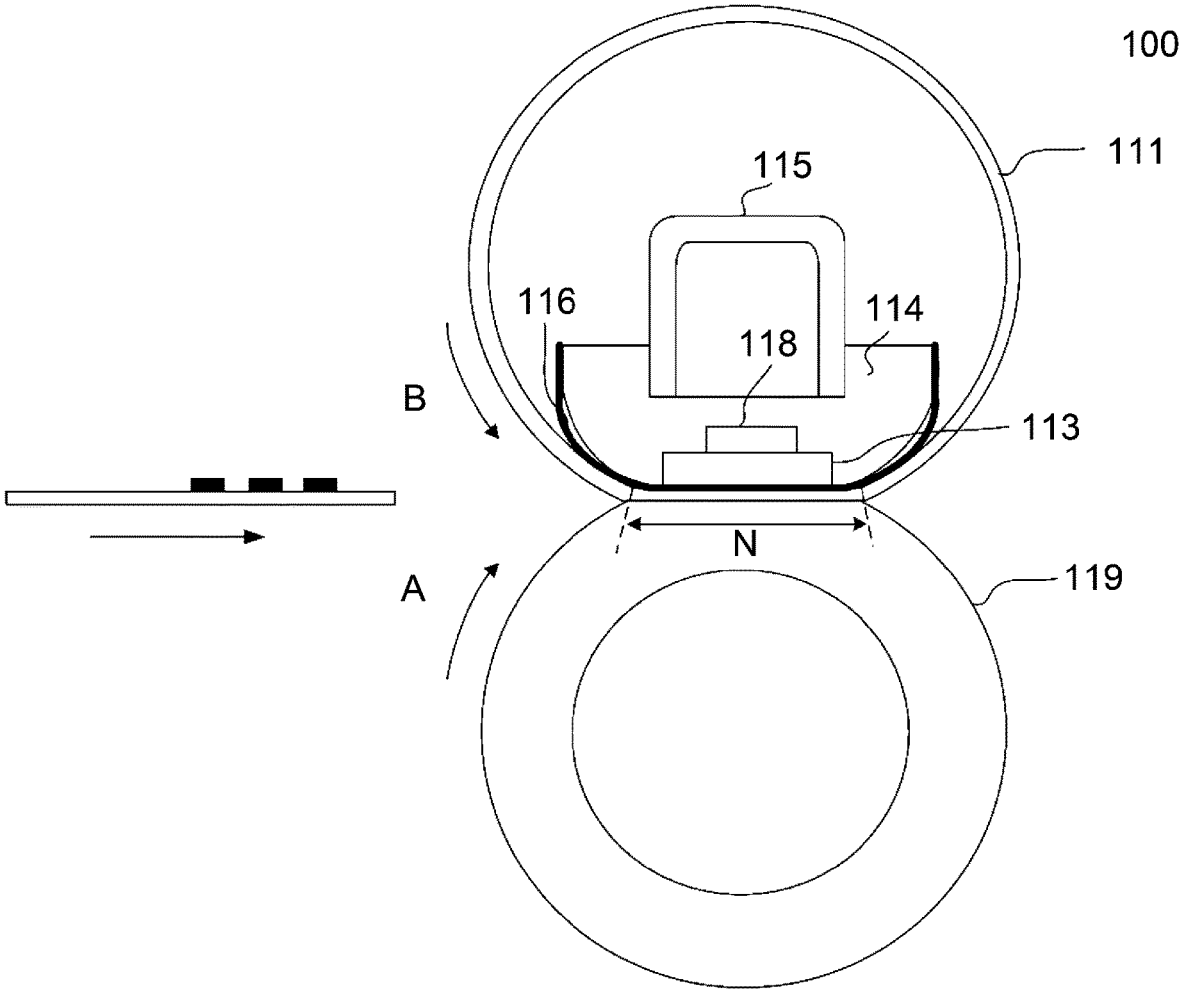
FIG. 1 is a cross-sectional view of the fixing apparatus in the first embodiment of the present invention.

FIG. 1 is a sectional view of the fixing apparatus 100 which employs a fixation belt (fixation film) which is in accordance with the present invention.

The fixation belt 111 in this embodiment is a fixing member which is in the form of an endless belt. The fixation belt 111 comprises a cylindrical substrative layer, an eleastic layer, and a piece of tube. The cylindrial substative layer is formed of stainless steel (SUS) and is roughly 50 μm in thickness. The elastic layer is formed of silicone rubber on the outward surface of the substrative layer and is roughly 200 μm in thickness. The piece of tube is formed of tetrafluoroethylene-perfluoro-alkylvinyl-ether (PFA), in such a manner that it covers the outward surface of the elastic layer and is roughly 30 μm in thickness. By the way, choice of the material for the substrative layer of the fixing member is not limited to the stainless steel. It may be nickel, heat resistant resinous material such as polyimide, or the like.

A holding member 114 holds a heater. The heater holding member 114 is formed of liquid polymer resin, which is heat resistant and rigid.

A heater 113 is the heat source of the fixing apparatus 100. The heater 113 has a long, narrow, and flat ceramic substrate, an electrically resistive member, a protective layer, and a pair of electrodes. The electrically resistive member is formed on the ceramic substrate in a manner to extend in the direction parallel to the lengthwise direction of the substrate and quickly generates heat as electric current is flowed through the electrically resistive member. The protective layer is formed of glass in a manner to protect the electrically resistive member. The pair of electrodes are formed on the lengthwise ends of the resistive member to apply voltage to the resistive member.

The heater holding member 114 is provided with a groove which extends in the direction parallel to the rotational axis of the fixation belt 111 (which hereafter may be referred to simply as lengthwise direction). The heater 113 is placed in this groove and is glued to the heater holding member 114 with heat resistant adhesive. The fixation belt 111 is loosely fitted around the heater holding member 114.

A stay 115 is a highly rigid supporting member. The stay 115 is formed of a sheet of stainless steel. The stay 115 is U-shaped in cross-section. The heater holding member 114 is fixed to the stay 115 and reinforced by the stay 115.

A pressure roller 119, as a pressing member, is made up of a metallic core formed of stainless steel, a roughly 3 mm thick silicone rubber layer formed on the peripheral surface of the metallic core by injection molding, and a piece of roughly 40 μm thick PFA resin tube, which covers the silicone rubber layer. A fixation nip N, which is necessary for fixation and has a preset width, is formed by pressing the combination of the heater holding member 114 and heater 113 against the pressure roller 119 by an unshown pressing mechanism 211, with the positioning of the fixation belt 111 between the combination and pressure roller 119.

The pressure roller 119 is rotationally driven by an unshown driving mechanism 212 in the direction indicated by an arrow mark A at a preset peripheral velocity. Thus, the fixation belt 111, which remains pressed upon the peripheral surface of the pressure roller 119, is rotated by the friction which the pressure roller 119 generates between itself and fixation belt 111 as it rotates. The inward surface of the fixation belt 111 is coated with heat-resistant grease, as lubricant, which contains fluorinated resin, in order to ensure that the fixation belt 111 smoothly slides on a thermally conductive sheet 116, which is described later.

A thermistor 118, as a temperature detecting means, is positioned so that it will be at roughly the center of a sheet of recording medium, in terms of the widthwise direction of the fixation belt 111, regardless of sheet size. The thermistor 118 detects the temperature of the heater 113. The electrical power to be supplied to the heater 113 is controlled so that the temperature detected by the central thermistor reaches, and remains at, a target level.

While the pressure roller 119 and belt 111 are rotationally driven and the heater 113 is controlled so that it temperature remains at the target level, a sheet P of recording medium, which is bearing an unfixed toner image, is conveyed to the nip N and, then, is conveyed through the nip N. As the sheet P and the toner image thereon are conveyed through the nip N and remain pinched between the fixation belt 111 and pressure roller 119, they are heated by the heat which they receive from the heater 113 through the fixation belt 111. Consequently, the toner image becomes fixed to the surface of the sheet P. After being conveyed through the nip N, the sheet P separates from the fixation belt 111 at the exit side of the nip N because the fixation belt 111 curves diagonally upward at the exit, whereas the sheet P remains straight because of its resiliency.

Next, referring to FIG. 4 which shows the configuration and positioning of a conventional thermally conductive sheet 116. As will be evident from FIG. 4, the conventional thermally conductive sheet 116 is such that it is only slightly wider, in terms of the widthwise direction of the combination of the heater 113 and heater holding member 114, than the combination, being therefore capable of opposing only the portion of the fixation belt 111 that corresponds in position to the nip N. Therefore, it is not satisfactorily effective to enable the fixation belt 111 to smoothly slide on the combination of the heater 113 and heater holding member 114. Therefore, the fixation belt 111 is likely to stick and slip as it slides on the combination. That is, the fixation belt 111 is likely to unsatisfactorily rotate.

Figure 5:
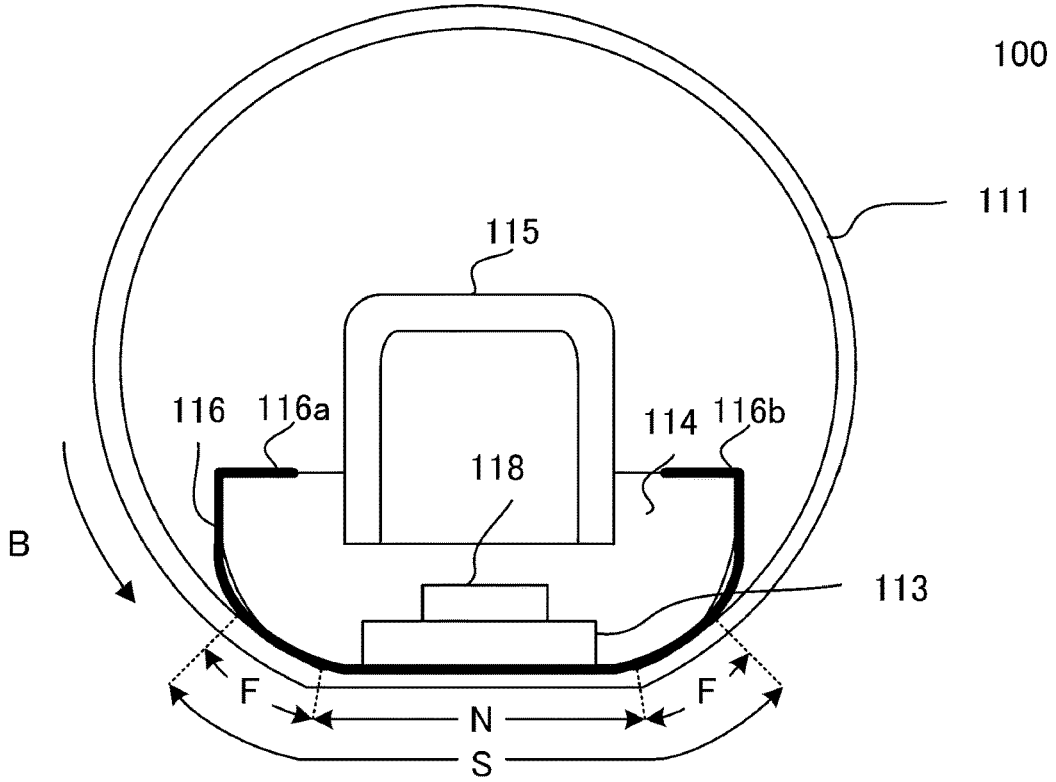
FIG. 5 is a cross-sectional view of the fixation belt unit in the first embodiment; it shows the nip of the fixing apparatus in detail.

FIG. 5 shows the configuration and positioning of the thermally conductive sheet 116 in this embodiment.

In this embodiment, the fixing apparatus 100 is provided with the thermally conductive sheet 116, which is configured and position so that it positioned between the fixation belt 111 and the combination of the heater 113 and holding member 114, in such a manner that, were it not for the thermally conductive sheet 116, the fixation belt 111 would come into contact with the combination, at least while the fixation belt 111 is rotated. While the fixation belt 111 rotates under the pressure, it does not always remain stable in its path. That is, it possibly comes into contact with the heater holding member 114, within ranges F shown in FIG. 5. Thus, the thermally conductive sheet 116 is configured and positioned in such a manner that it covers the portion of the downwardly facing surface of the combination of the heater 113 and heater holding member 114, which is in the area S which includes the areas F and nip N, in terms of the circumferential direction of the fixation belt 111.

The thermally conductive sheet 116 is roughly semicircular in cross-section. It is held to the holding member 114 by its widthwise edge portions 116*a* and 116*b* (end portions in terms of circumferential direction of fixation belt 111) which are fixed to the holding member 114. Its length is roughly the same as the width of the fixation belt 111.

The material for the thermally conductive sheet 116 is desired not to impede heat transmission from the heater 113 to fixation belt 111. It is desired to be no less than 10 W/(m·° C.) in thermal conductivity 2. Further, it is desired to be no less than 0 μm, and no more than 50 μm, in thickness t.

Further, it is desired that, while the fixation belt 111 is sliding on the thermally conductive sheet 116 by its inward surface, it is lower in coefficient of friction, and greater in wear resistance, than the heater holding member 114. In a case when the material for the thermally conductive sheet 116 is metallic, the material is desired to be no less than 60 in Vicker's hardness scale HV as an index for wear resistance. In this embodiment, a sheet of stainless steel (SUS) which is 16 16 W/(m·° C.) in thermal conductivity λ, 200 in HV, and 20 μm in thickness was used as the material for the thermally conductive sheet 116.

The thermal conductivity of the thermally conductive sheet 116 was measured using the following procedure.

A test piece was cut out of the material for the thermally conductive sheet 116. Then, the thermal diffusivity of the test piece in terms of its thickness direction is measured with the use of a thermal diffusiveness measuring apparatus (Model FTC-1; product of AlVAC Riko Co., Ltd.). Then, the thermal diffusivity of each material in terms of its thickness direction is obtained from the following formula.

Thermal conductivity=thermal diffusivity×specific gravity×specific heat.

The specific gravity of the material is obtained by measuring the specific gravity of the test piece by an electronic gravimeter (model SD-200L; product of Alphamirage Co., Ltd.).

Further, the specific heat of the material was obtained by measuring the specific heat of the test piece by a differential scanning calorimeters (Model DSC8240; product of Rigaku Co., Ltd.).

By the way, choice of the material for the thermally conductive sheet 116 is not limited to the abovementioned ones. It may be metal such as stainless steel, and nickel, or alloys. Further, it may be a sheet of heat-resistant resin such as polyimide (PI), poly phenylene-sulfide (PPS), polyether-ether-keton (PEEK), which is highly wear-resistant.

Figure 6:
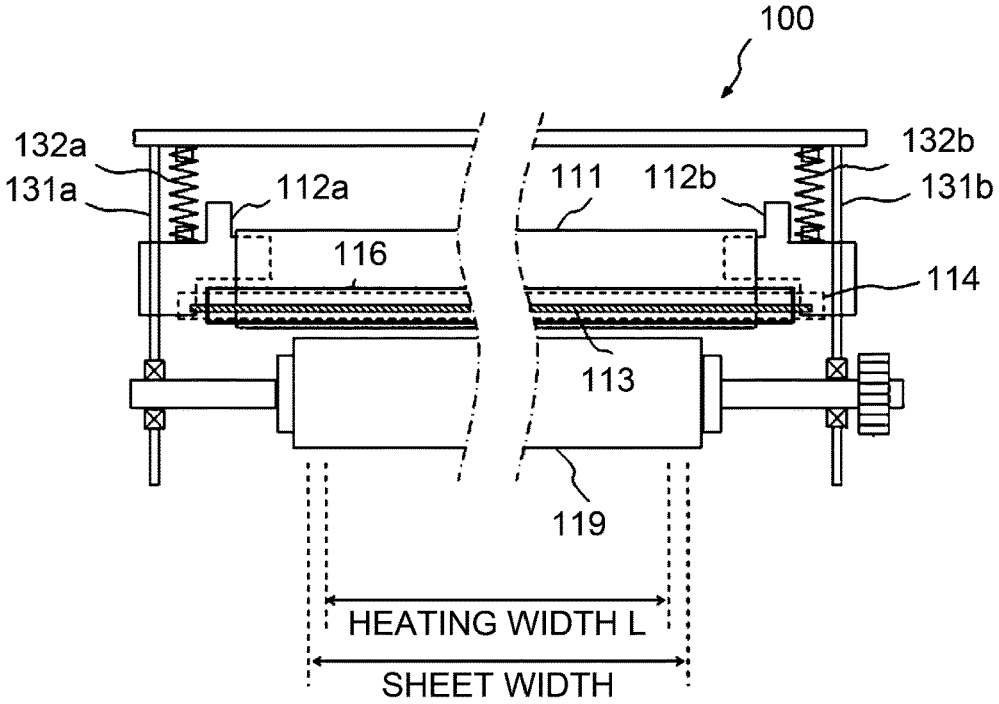
FIG. 6 is a side view of the fixing apparatus in the first embodiment.

FIG. 6 is a side view of the fixing apparatus 10 as seen in the recording medium conveyance direction. It shows the positioning of the fixation belt 111 and thermally conductive sheet 116 in terms of their lengthwise direction.

The fixation belt 111 is supported by a pair of supporting members 112*a* and 112*b* fitted in the hollow of the widthwise ends of the fixation belt 111. The holding member 114 is disposed in the hollow of the fixation belt 111 in such a manner that it bridges between the supporting members 112*a* and 112*b*. The heater 113 is fixed to the holding member 114 with adhesive. Each of the pair of supporting members 112*a* and 112*b* is provided with an unshown semicircular protrusion, which protrudes outward of the supporting member 112 in the direction which is perpendicular to its axial line. Thus, as the fixation belt 111 deviates in position in its widthwise direction, the fixation belt 111 comes into contact with the protrusion, being thereby prevented from deviating further and regulated in position in terms of its widthwise direction. The supporting members are supported by a pair of frames 131*a* and 131*b*, respectively, of the fixing apparatus 100 in such a manner that they are allowed to slide relative to the frames 113*a* and 113*b*, respectively. It is also by these frames 113*a* and 113*b* that the pressure roller 119 is supported. Further, the supporting members 112*a* and 112*b* are under the pressure generated toward the pressure roller 119 by a pair of compression springs 132*a* and 132*b*, respectively. Thus, the combination of the holding member 114 and heater 113 remains pressed against the pressure roller 119 with the presence of the fixation belt 111 between the combination and pressure roller 119.

FIG. 7 shows the results of the comparison tests among the fixing apparatus 100 in this embodiment, comparative fixing apparatuses 114, and a conventional fixing apparatus, in terms of the occurrence or nonoccurrence of the "sticks and slips" phenomenon In the tests, the fixing apparatuses were made different in the positioning, material, and thickness of their thermally conductive sheet 116. The heater temperature was set to 200° C., and the apparatuses were tested regarding the occurrence or nonoccurrence of the "sticks and slips" phenomenon, while rotating the fixation belt 111 under the aforementioned pressure. In addition, in order to evaluate the apparatuses in the thermal conductivity from the heater 113 to the fixation belt 111, the heater temperature T at which the surface temperature of the fixation belt 111 became stable at 180° C. while the fixation belt 111 was rotated under the pressure, was measured. The surface temperature of the fixation belt 111 was measured by an electronic thermo-couple sensor, whereas the heater temperature T was measured with a thermistor 117. In the cases of comparative fixing apparatuses 1-3, the thermally conductive sheet 116 was positioned only in the area S, which is the same as where the sheet 116 was positioned in the fixing apparatus 100 in the first embodiment. It is evident from FIG. 7 that in the cases of the first and second comparative fixing apparatuses, the materials for the thermally conductive sheet 116 of which were 100 μm thick SUS, and glass which was 1.3 W/(m·° C.) in λ, the sheets were lower in thermal conductivity, and the heater temperature was higher than in the case of the fixing apparatus in the first embodiment. In the case of the third comparative fixing apparatus, the material for the thermally conductive sheet 116 for which was aluminum sheet which was 60 in hardness HV, "sticks and slips" phenomenon occurred. Further, also in the case of the conventional fixing apparatus, the thermally conductive sheet 116 was configured and positioned only in the area N, which corresponds in position to nip N, the fixation belt 111 did not satisfactorily rotate because of the occurrence of "sticks and slips" phenomenon.

As described above, by configuring and positioning the thermally conductive sheet 116 so that it is between the fixation belt 111 and the combination of the heater and heater holding member, and in the area in which the fixation belt will possibly come into contact with the combination if the sheet is not present, it is possible to prevent the occurrence of the problem that the fixation belt unsatisfactorily rotates because the fixation belt 111 "sticks and slips" as it slides on the combination of the heater and heater holding member.

Embodiment 2

Figure 8:
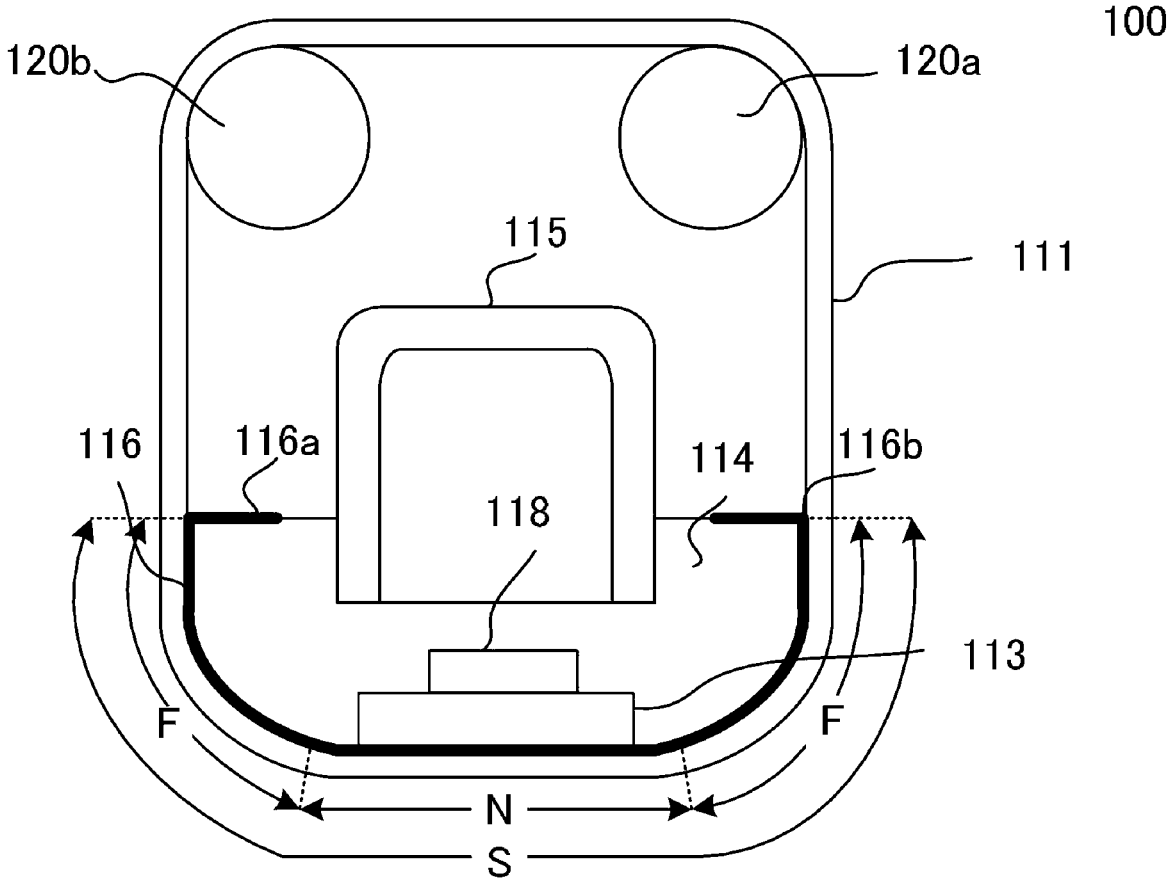
FIG. 8 is a sectional view of the fixation belt unit in the second embodiment of the present invention.

FIG. 8 is a schematic cross-sectional view of the fixation belt unit in another embodiment of the present invention showing the structure of the unit. The members of the fixation belt unit in FIG. 8 that are the same in structure as the counterpart in the first embodiment are not described. By the way, the members in FIG. 8 which are the same as the counterparts in the first embodiment are given the same reference characters as those discussed above.

In this embodiment, the fixation belt 111 is suspended and tension by a pair of suspending-tensioning rollers 120*a* and 120*b*. In comparison to the fixing apparatus in the first embodiment, the fixing apparatus 100 in this embodiment is kept more stable in the path of the fixation belt 111 by the suspending-tensioning rollers 120. Therefore, while the fixation belt 111 is rotationally driven, the fixation belt 111 always remains in contact with the holding member 114 in the area F. Although FIG. 8 shows only one example of fixing apparatus 100 of this type, providing the fixing apparatus 100 with the pair of suspending-tensioning rollers 120*a* and 120*b*, and positioning the rollers 120*a* and 120*b* as shown in FIG. 8 widens the area F, making it more likely for the fixation belt 111 to stick and slip as it slides on the combination of the heater and heater holding member, in comparison to the fixing apparatus 100 in the first embodiment. In this embodiment, therefore, the thermally conductive sheet 116 is configured so that it matches in size, the area S in which the fixation belt 111 is likely to come into contact with the combination of the heater 113 and fixation belt 111, and is positioned between the fixation belt 111 and the combination while the belt 111 is being rotated. Therefore, it was possible to prevent the problem that the fixation belt 111 sticks and slips as it slides on the combination. Therefore, it was possible to prevent the problem that the fixation belt 111 unsatisfactorily rotates because the fixation belt 111 sticks and slips.

Embodiment 3

Figure 9:
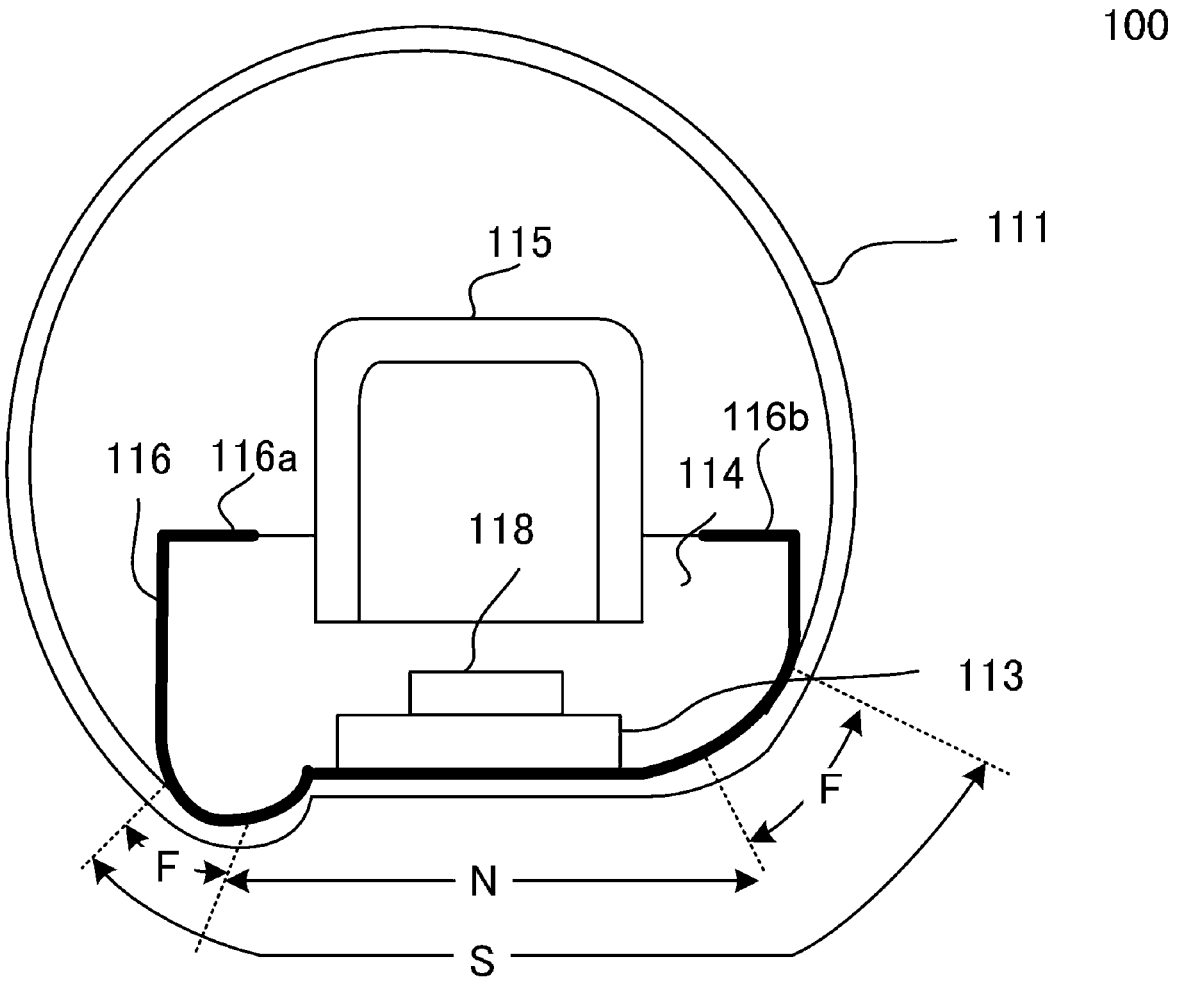
FIG. 9 is a sectional view of the fixation belt unit in the third embodiment of the present invention.

FIG. 9 is a schematic cross-sectional view of the fixation belt unit in another embodiment of the present showing the structure of the unit. The members, components, etc., of the unit, that are the same in structure as the counterparts in the first embodiment described above are not described here. The members of this that are the same as the counterparts in the first embodiment are given the same reference characters as those discussed above.

In this embodiment, the holding member 114 is provided with a protrusive portion 114*a*, which is in the form of roughly half the cylindrical column, and protrudes toward the pressure roller 119 from the downstream edge of the main structure of the holding member 114. The protrusive portion 114*a* increases in curvature, the portion of the fixation belt 111, which is in contact with the protrusive portion 114*a*, making it easier for the recording medium to separate from the fixation belt 111.

In a case when the heater holding member 114 has a protrusive portion such as the one in this embodiment, the thermally conductive sheet 116 is desired to follow the contour of the protrusive portion 114*a* to satisfactorily release. Further, for the purpose of ensuring that the thermally conductive sheet 116 remains airtightly in contact with the surface of the heater 113 so that heat is efficiently conducted from the heater 113 to the fixation belt 111 through the thermally conductive sheet 116, it is desired that the thermally conductive sheet 116 can follow the contour of the surface of the heater 113. Therefore, it is desired that the thermally conductive sheet 116 is less resistant than the fixation belt 111 to a force that works on the thermally conductive sheet 116 in a bending direction perpendicular to the circumferential direction of the fixation belt 111.

In the first to third embodiments, the substrative layer of the fixation belt 111 was formed of stainless steel, and 50 μm in thickness. The other layers (rubber layer and PFA layer) of the fixation belt 111 than the substrative layer are less resistant to bending than the substrative layer. Therefore, the overall resistance of the fixation belt 111 to bending is determined by the resistance of the substrative layer to bending. Further, the thermally conductive sheet 116 was formed of stainless steel, and was 20 μm in thickness, which is less than the thickness of the substrative layer. Therefore, the thermally conductive sheet 116 was less resistant to bending than the fixation belt 111. Therefore, the thermally conductive sheet 116 conformed to the contour of the combination of the heater 113 and heater holding member 114 as described above.

As described above, even if the fixation belt unit is structured so that the portion of the downwardly facing portion of the surface of the holding member 114, which is in the area S in FIG. 9, has a complex contour which has various curvatures, it is possible to prevent the problem that the fixation belt 111 unsatisfactorily rotates because of the "sticks and sticks" phenomenon that occurs between the fixation belt 111 and the combination of the heater and heater holding member by the placement of the thermally conductive sheet 116 in the area S in which the fixation belt 111 may come into contact with the fixation belt 111 while the fixation belt 111 is rotationally driven.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image fixing device for fixing an image on a recording material, said fixing device comprising:

a rotatable fixing film rotating in a rotational direction and having an inner surface and an outer peripheral surface;

a heater provided on the inner surface side of said fixing film;

a rotatable pressing member provided in contact with the outer peripheral surface of said fixing film to press against said heater through said fixing film, thus forming a nip configured to nip and to feed the recording material, to heat an image on the recording material, and to fix the image onto the recording material;

a holding member provided on the inner surface side of said fixing film, said holding member being configured to hold said heater and including a guide portion configured to guide the rotation of said fixing film, said holding member having a first surface and a second surface opposing the first surface; and a metal sheet that covers said heater and said guide portion, said metal sheet being disposed along said guide portion of said holding member and having a first end in the rotational direction of said fixing film and a second end in the rotational direction of said fixing film, the first end of said metal sheet being fixed on the first surface of said holding member and the second end of said metal sheet being fixed on the second surface of said holding member, wherein said metal sheet has a thermal conductivity of 10 W/(m·°C.) or less and has a thickness of more than 0 μm and not more than 50 μm.

2. The image fixing device according to claim 1, wherein said fixing film includes a metal layer having a thickness larger than that of said metal sheet.

3. The image fixing device according to claim 1, wherein said metal sheet has a Vickers hardness of not less than sixty.

4. The image fixing device according to claim 1, wherein said fixing film includes a metal base layer, an elastic layer provided on said base layer, and a parting layer provided on said elastic layer.

5. The image fixing device according to claim 1, wherein said heater is a planar heater.

6. The image fixing device according to claim 1, wherein said holding member is made of resin material.

7. The image fixing device according to claim 1, wherein said holding member includes a projected portion projecting outwardly of said fixing film at a position downstream of said heater in the rotational direction of said fixing film to separate the recording material from said fixing film.

8. The image fixing device according to claim 1, wherein said metal sheet has a bending stiffness greater than that of said fixing film.

9. The image fixing device according to claim 1, wherein said metal sheet includes an end on one side of the metal sheet in a longitudinal direction of said heater and an end on another end side of the metal sheet in the longitudinal direction of said heater, wherein said fixing film includes an end on one side of the fixing film in the longitudinal direction of said heater and an end on another end side of the fixing film in the longitudinal direction of said heater, and wherein each end of said metal sheet is positioned outside of a respective end of said fixing film in the longitudinal direction of said heater.

* * * * *